US005788590A

United States Patent [19]

Ervin

[11] Patent Number: 5,788,590

[45] Date of Patent: Aug. 4, 1998

[54] STICK GAME TOY

[76] Inventor: Robert Ervin, 399 Pico St., Morro Bay, Calif. 93442

[21] Appl. No.: 294,102

[22] Filed: Aug. 22, 1994

[51] Int. Cl.[6] ..... A63H 67/00

[52] U.S. Cl. ..... 473/514; 446/240

[58] Field of Search ..... 446/240, 255, 446/236, 266; 273/318, 340, 327, 412; 473/514, 509, 569

[56] References Cited

U.S. PATENT DOCUMENTS

| | | | |
|---|---|---|---|
| 2,167,992 | 8/1939 | Olsen | 446/240 X |
| 2,227,705 | 1/1941 | Colucci | 446/236 X |
| 3,069,804 | 12/1962 | Cirafesi . | |
| 3,443,809 | 5/1969 | Montanez . | |
| 3,528,659 | 9/1970 | Benham | 473/514 |
| 3,840,233 | 10/1974 | Patterson | 473/514 |
| 4,030,472 | 6/1977 | Watkins | 473/514 |
| 4,293,134 | 10/1981 | Retief et al. | 473/569 |
| 4,750,745 | 6/1988 | Benham | 473/514 |
| 4,881,741 | 11/1989 | Shapiro | 473/514 |
| 4,895,377 | 1/1990 | Arbor | 473/514 |
| 5,039,108 | 8/1991 | Arbor | 473/514 |

FOREIGN PATENT DOCUMENTS

| | | | |
|---|---|---|---|
| 2315548 | 10/1974 | Germany | 273/327 |

*Primary Examiner*—Mickey Yu
*Attorney, Agent, or Firm*—Coudert Brothers

[57] ABSTRACT

A stick game toy is provided having a curved catch stick having a handle at one end and a hook at the other end and a toss stick having a rod and a pair of guides located symmetrically about the center of the rod for balancing the toss stick between the two ends of the rod.

23 Claims, 2 Drawing Sheets

STICK GAME TOY

FIELD OF THE INVENTION

This invention relates generally to the field of aerial projectile toys and more particularly to a toy for use in a game in which a toss stick is caught and manipulated on a catch stick by one or more players.

BACKGROUND OF THE INVENTION

Examples of numerous stick game toys have been developed over the years and are disclosed and claimed in U.S. Pat. Nos. 3,069,804; 3,443,809; 3,528,659; 3,840,233; 4,030,472; 4,293,134; 4,750,745; 4,881,741; 4,895,377 and 5,039,108. Of these patents, only four are directed to the use of two sticks as in the stick game toy of the present invention.

U.S. Pat. Nos. 3,528,659 and 4,750,745 use a simple rod to toss, turn and otherwise play with the aerial projectile toy which includes another rod that is capped at each end with inwardly-containing pliable cups. In the latter toy, the capped rod has a fluted outer surface which creates a whistling sound when it is turned.

U.S. Pat. No. 4,881,741 is directed to a juggling toy using a rod capped at each end with flexible cups which can be flexed into various positions by a second rod.

U.S. Pat. No. 4,895,377 discloses and claims a juggling stick toy comprising a capped juggling rod and a simple rod that is used as the spinner stick. The central portion of one embodiment of the juggling rod included a pair of disks symmetrically located around the center of the stick.

The remaining prior art patent listed above are of general interest to show the state of the art of toys which use only one stick.

SUMMARY OF THE INVENTION

The stick game toy of the present invention is designed to provide the player with a greater number of options for spinning, hitting, balancing, tossing, juggling or other manipulation of a toss stick by a catch stick than the stick game toys of the prior art.

The stick game toy of the present invention comprises a curved catch stick having a handle at one end and a hook at the other end and a toss stick comprising a rod and a pair of guides located symmetrically about the center of the rod for balancing the toss stick on the catch stick between the two ends of the rod.

In one embodiment of the stick game toy of the present invention, the catch stick has length, width, and thickness, with the length substantially greater than the width, a first end, a second end, a handle at the first end, a hook at the second end, and a curved shaft between the handle and the hook. The hook is used to pick up and capture the toss stick. The pair of guides on the toss stick are used to guide or otherwise position the toss stick generally within the area of the midpoint of the toss stick and at any point around its circumference.

In a preferred embodiment of the present invention, the thickness of the catch stick ranges from about twice to about equal to the width. The shaft of the catch stick is in the form of a smooth, continuous curve from the inside edge of the handle to the hook. The catch stick has a substantially flat top surface which serves as the catch area for the toss stick, an upwardly directed U-shaped cross-section, and a thickness that is tapered from the handle to the hook. The toss stick comprises a rod having a diameter that is substantially the same as the width of the catch stick at its narrowest cross-section, i.e., adjacent to the hook. The toss stick is capped at each end with bumpers of a resilient material to protect the player and to act as a stop for the catch stick. The combination of the hook and the curvature and the flat surface of the shaft enables the player to have an almost infinitive number of possibilities for manipulating the toss stick.

DETAILED DESCRIPTION OF THE PREFERRED EMBODIMENT

Figure 1:
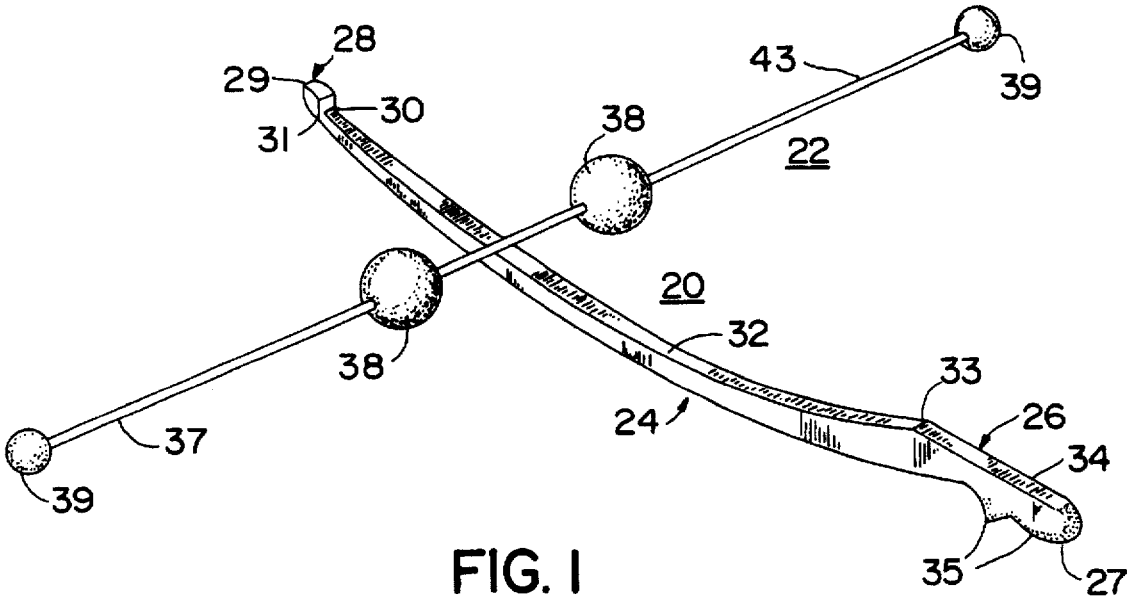
FIG. 1 is a top, front and left side perspective view of a preferred embodiment of the stick game toy of the present invention.

Referring now to the FIG. 1, catch stick 20 is shown in a position either about to catch or after catching toss stick 22. Catch stick 20 was made from a solid piece of Philippine mahogany and had a length of about 31 inches. This dimension and other dimensions set forth in the description of the preferred embodiment are merely illustrative and are not critical to the stick toy of this invention. The length of catch stick 20 can be in a range of about 24 to 36 inches and be made of any type of wood, plywood, moldable plastics, fiber glass and similar materials. Shaft 24 of catch stick 20 was tapered in thickness from handle 26 at first end 27 to tapered tip 28 at second end 29. First end 27 and second end 29 was separated by about 31 inches. The width and thickness of catch stick 20 adjacent handle 26 was about ½ inch and 1¼ inches, respectively. The thickness of catch stick is generally in the range from about twice to about equal to its width. The width and thickness of shaft 24 at neck 30 was about ¼ inch and ⅜ inch, respectively. Each side of shaft 24 was tapered so that the width of shaft 24 about 6 inches from neck 30 was ½ inch necked down to ⅜ inch at neck 30. Tip 28 had a width of approximately ⅝ inch adjacent neck 30 and a length from end 29 to neck 30 of approximately ¾ inch. The thickness of tip 28 at its thickest cross-section adjacent to neck 30 was about twice the thickness of neck 30. Tip 28 is designed to aid the player of the stick game in moving second end 29 under toss stick 22. After tip 28 is under neck 30, it slides along side wall 31 to top surface 32 of shaft 24. In the preferred embodiment shown in FIGS. 1, 2, and 4, side wall 31 is distal to second end 29, is substantially perpendicular to the longitudinal axis of catch stick 20 and has a slight outward taper from neck 30 toward end 29. In this manner, tip 28 forms a hook or stop for toss stick 22. This feature aids the player in retrieving toss stick 22 from the playing field. To further aid the player in retrieving stick 22, at least a portion of the width of shaft 24 was tapered adjacent neck 30. The width of tip 28 is generally approximately equal to its length.

Figure 4:
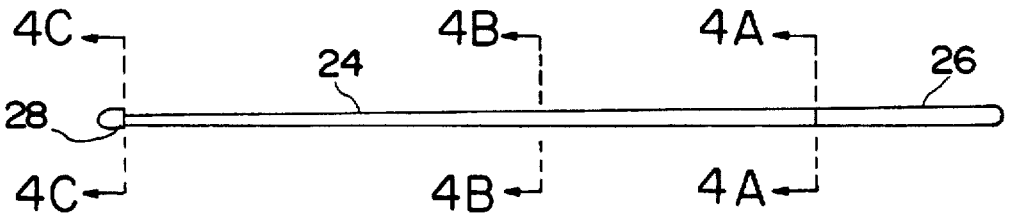
FIG. 4 is a top view of the preferred embodiment of the toss stick showing vertical sectional views taken along A—A, B—B and C—C.
Figure 4C:
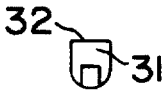
FIG. 4C is the vertical sectional view taken along C—C. Each of the vertical section of FIGS. 4A–4C are shown over scale.
Figure 4B:
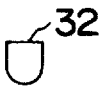
FIG. 4B is the vertical sectional view taken along B—B.
Figure 4A:
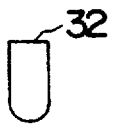
FIG. 4A is the vertical sectional view taken along A—A.

Top surface 32 of shaft 24 was flat from inside edge 33 of handle 26 to tip 28. Catch stick 20 had an upwardly directed U-shaped cross-section as shown in FIG. 4 and a length of approximately 24 inches. Handle 26 was also flat on top 34 for a distance of 6½ inches. Neither the shape nor the size of handle 26 is critical to the design of catch stick 20. Handle 26 of the embodiment shown in FIGS. 1–2 had two arches 35 on its bottom to form a grip for the player's hand. In another embodiment, handle 26 was designed to simply be an integral extension from edge 33 of shaft 24 without arches or it can be designed with more than two arches.

Toss stick 22 was formed from solid plastic rod 37 having a length of approximately 36 inches and a diameter of approximately ¼ inches. Toss stick 22 can have a length in the range of about 18 to about 42 inches and a diameter in the range of about 3/16 to about ¾ inches. It can be made of the same type of materials as that of catch stick 20. Two hollow plastic spheres 38 having a diameter of approximately 2 inches were spaced centrally, approximately 5 inches apart on rod 33. Spheres 38 can be replaced by disks or other means so the player can direct catch stick 20 between the pair of guides and assure that toss stick 22 is caught generally about the midpoint of rod 37. Spheres or disks 38 range from about 1½ to about 3 inches in diameter and are usually spaced in the range of about 3 to about 6 inches apart. A pair of rubber spherical bumpers 39 having a diameter of approximately 1 inch were mounted on each end of rod 22. The diameter of the bumpers can vary from about ¾ to 3 inches in diameter. Functionality as well as safety are factors in choosing a resilient material such as a plastic and/or rubber for spheres 38 and bumpers 39. Safety is also a factor in choosing the exact diameter of bumpers 39.

Figure 2:
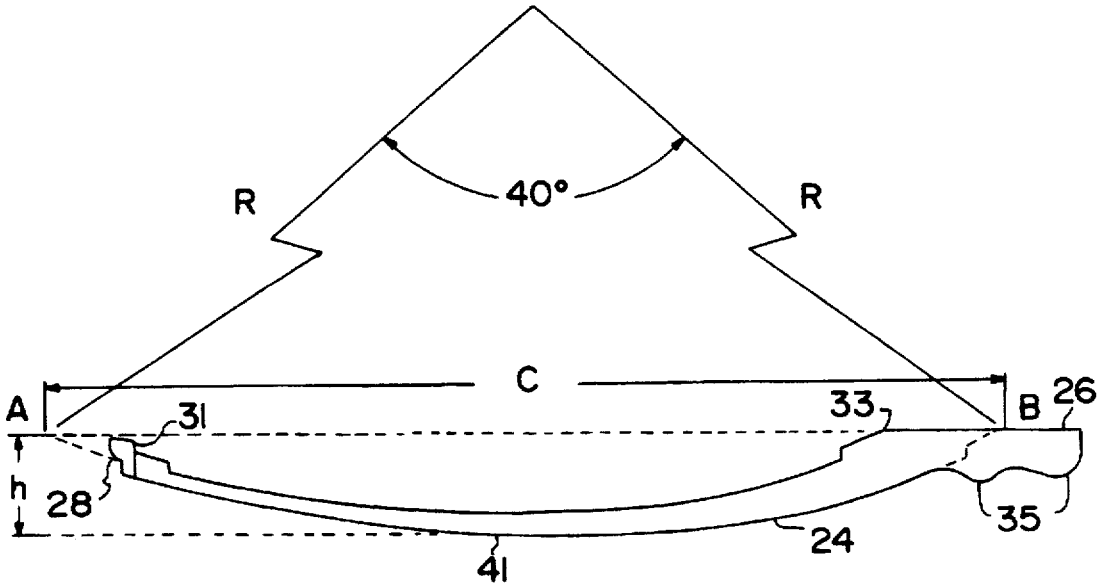
FIG. 2 is a side view of the preferred embodiment of the catch stick.
Figure 3:
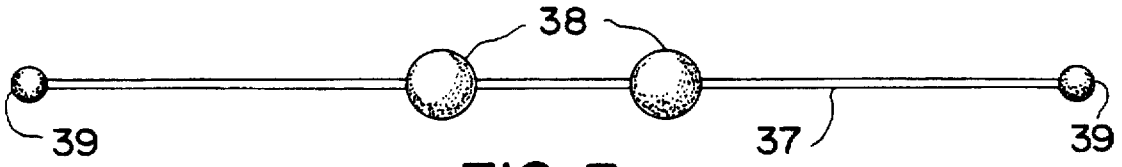
FIG. 3 is a top view of the preferred embodiment of the catch stick.

The height, "h", was 2⅝ inches of annulus 40 formed between an imaginary chord "C" and bottom 41 of shaft 24 as shown in FIG. 2. Since chord "C" between points "A" and "B", had a length of approximately 29 inches, the imaginary circle, that was used to form the curvature of curved shaft 24, had a radius "R" of about 42 inches and the central angle, θ, of annulus 40 was about 40°. Since this degree of curvature of catch stick 20 is not critical, "h" can vary in the range of about 2 to about 5 inches, θ can vary from about 20° to about 90°.

The toy of this invention is used in a variety of games which enhance skills of agility, timing, focus, hand-eye coordination, and balance. The individual or multiple players spin, balance, hit, throw, juggle or similarly manipulate the toss stick. The benefits of the use of the toy range from cardiovascular exercise, relaxation, stress management, manual dexterity, and amusement.

In playing a game with the toy of this invention, the player begins by picking up toss stick 22 between pair of spheres 34 with catch stick 20. Tip 28 easily slides underneath toss stick 22 lodges against side wall 31 on top 32 to make its retrieval possible without bending over and picking it up by hand. It is desirable in any game to keep the longitudinal axis of toss stick 22 generally perpendicular to longitudinal axis 43 of catch stick 20. Once toss stick 22 is in such a perpendicular position with respect to catch stick 20, it can be spun, hit, balanced, tossed or otherwise manipulated. In active play, the player juggles and throws toss or spinning stick 22 in the air, sometimes at heights of up to about 20 feet. The player is often required to make dynamic movements with the player's body as well as with the toy of this invention. In a fast game, the player may be required to kick, leap, and run to cover a large area of ground. In a slower game, the player may concentrate more on balancing, rocking, sliding, lifting and spinning toss stick 22 for periods of time without causing it to fall to the ground. The contact of toss stick 22 with catch stick 20 is within the narrow space between spheres 38. It is desirable that the player keep the knees slightly bent and the body loose and flexible during a game with the toy of this invention.

When two or more players are involved, toss stick 22 is thrown and caught at right angles to catch stick 20. Adequate space is required so that the players can stand at least ten feet apart in a space of approximately 100 square feet. As with a single player, the object of the game may require a number of juggling movements to keep toss stick 22 in play before it is returned to the other player. One player may be required to keep the toss stick in play until it is dropped, with a point going to the other player. During such play, the other player can be counting the seconds out loud until it is dropped. The players can stand side by side or face to face or any combination of the two. Many variations of the game can be devised such as how high one can throw and still catch the toss stick, or how fast one player can pass the stick to the other without having it fall to the ground.

Without departing from the spirit and scope of this invention, one of ordinary skill in the art can make many other changes and modifications to either the toss stick or the catch stick of the present invention. As such, these changes and modifications are properly, equitably, and intended to be, within the full range of equivalents of the following claims.

What is claimed is:

1. A stick game toy which comprises:

a catch stick along a longitudinal axis having length, width, and thickness, the length substantially greater than the width, a first end, a second end, a handle at said first end, a hook at said second end, and a curved shaft between said handle and said hook, said hook comprising a tip at said second end and a side wall distal the second end that is substantially perpendicular to the longitudinal axis of catch stick; and a toss stick comprising a rod and a pair of guides located symmetrically about the center of said rod for balancing said toss stick between the two ends of said rod.

2. The stick game toy of claim 1 wherein said guides are a pair of spheres.

3. The stick game toy of claim 2 wherein each of said spheres has a diameter in the range of about 3 to 5 times the diameter of said rod.

4. The stick game toy of claim 3 wherein the space between said spheres is equal to approximately the diameter of said spheres.

5. The stick game toy of claim 1 wherein said guides are a pair of disks.

6. The stick game toy of claim 5 wherein each of said disks has a diameter in the range of about 3 to 5 times the diameter of said rod.

7. The stick game toy of claim 6 wherein the space between said disks is equal to approximately the diameter of said disks.

8. The stick game toy of claim 1 wherein a pair of bumper guards are located at each end of said rod for protecting the player of the stick game.

9. The stick game toy of claim 8 wherein said bumper guards are a pair of resilient disks.

10. The stick game toy of claim 1 wherein the thickness of said catch stick is in the range from about twice to about equal to the diameter of said catch stick.

11. A stick game toy which comprises:

a catch stick along a longitudinal axis having length, width, and thickness, the length substantially greater than the width and the thickness ranges from about twice to about equal to the width, a first end, a second end, a handle at said first end, a tip at said second end having a side wall distal to said second end to form a hook, said side wall being substantially perpendicular to the longitudinal axis of catch stick; and a shaft in the form of a smooth, continuous curve between said handle and said tip, said shaft having a flat top surface and a thickness that is generally tapered from said handle to said hook and having an upwardly directed U-shaped cross-section; and a toss stick comprising a rod having a diameter that is substantially the same as the width of said catch stick adjacent to said tip, and a pair of guides located symmetrically about the center of said rod for balancing said toss stick between the two ends of said rod.

12. The stick game toy of claim 11 wherein said guides are a pair of spheres.

13. The stick game toy of claim 12 wherein each of said spheres has a diameter in the range of about 3 to 5 times the diameter of said rod.

14. The stick game toy of claim 13 wherein the space between said spheres is equal to approximately the diameter of said spheres.

15. The stick game toy of claim 11 wherein said guides are a pair of disks.

16. The stick game toy of claim 15 wherein each of said disks has a diameter in the range of about 3 to 5 times the diameter of said rod.

17. The stick game toy of claim 16 wherein the space between said disks is equal to approximately the diameter of said disks.

18. The stick game toy of claim 11 wherein a pair of bumper guards are located at each end of said rod for protecting the player of the stick game.

19. The stick game toy of claim 18 wherein said bumper guards are a pair of resilient spheres.

20. The stick game toy of claim 18 wherein said bumper guards are a pair of resilient disks.

21. The stick game toy of claim 11 wherein the height of an annulus formed between an imaginary chord and the bottom of the curved shaft of said catch stick is in the range of about 2 to about 5 inches.

22. The stick game toy of claim 11 wherein said handle has arches to form a hand grip.

23. The stick game toy of claim 11 wherein the width of said shaft is tapered for at least a portion of its length adjacent said hook.

* * * * *